US007163444B2

(12) United States Patent
Kollodge et al.

(10) Patent No.: US 7,163,444 B2
(45) Date of Patent: Jan. 16, 2007

(54) PAD CONSTRUCTIONS FOR CHEMICAL MECHANICAL PLANARIZATION APPLICATIONS

(75) Inventors: Jeffrey S. Kollodge, Stillwater, MN (US); Christopher N. Loesch, Hastings, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/744,761

(22) Filed: Dec. 23, 2003

(65) Prior Publication Data

US 2004/0137831 A1 Jul. 15, 2004

Related U.S. Application Data

(60) Provisional application No. 60/439,314, filed on Jan. 10, 2003.

(51) Int. Cl.
*B24B 7/22* (2006.01)

(52) U.S. Cl. ..... 451/41; 451/533; 51/298

(58) Field of Classification Search ..... 451/532, 451/533, 526, 527, 528, 529, 530, 531, 536; 51/298, 297, 299
See application file for complete search history.

(56) References Cited

U.S. PATENT DOCUMENTS

| | | | | |
|---|---|---|---|---|
| 4,055,897 | A * | 11/1977 | Brix | 433/166 |
| 4,927,432 | A | 5/1990 | Budinger et al. | |
| 5,110,843 | A | 5/1992 | Bries et al. | |
| 5,152,917 | A | 10/1992 | Pieper et al. | |
| 5,514,245 | A | 5/1996 | Doan et al. | |
| 5,667,541 | A | 9/1997 | Klun et al. | |
| 5,692,950 | A * | 12/1997 | Rutherford et al. | 451/552 |
| 5,897,426 | A | 4/1999 | Somekh | |
| 5,913,712 | A | 6/1999 | Molinar | |
| 5,958,794 | A | 9/1999 | Bruxvoort et al. | |
| 6,007,407 | A | 12/1999 | Rutherford et al. | |
| 6,180,020 | B1 | 1/2001 | Moriyama et al. | |
| 6,194,317 | B1 | 2/2001 | Kaisaki et al. | |
| 6,231,629 | B1 | 5/2001 | Christianson et al. | |
| 6,234,875 | B1 | 5/2001 | Pendergrass, Jr. | |
| 6,383,066 | B1 | 5/2002 | Chen et al. | |
| 6,435,942 | B1 | 8/2002 | Jin et al. | |
| 6,461,226 | B1 | 10/2002 | Yi | |
| 6,620,725 | B1 | 9/2003 | Shue et al. | |
| 6,736,714 | B1 * | 5/2004 | Dudovicz | 451/536 |
| 2001/0051500 | A1 | 12/2001 | Homma et al. | |
| 2002/0002028 | A1 | 1/2002 | Torii et al. | |
| 2002/0004365 | A1 | 1/2002 | Jeong et al. | |
| 2002/0039880 | A1 | 4/2002 | Torii et al. | |
| 2002/0151253 | A1 | 10/2002 | Kollodge et al. | |
| 2002/0177386 | A1 | 11/2002 | Smith | |
| 2002/0192962 | A1 | 12/2002 | Miyashita et al. | |

FOREIGN PATENT DOCUMENTS

| | | |
|---|---|---|
| EP | 0 874 390 A1 | 10/1998 |
| EP | 1 077 108 A1 | 2/2001 |
| WO | WO 02/062527 A1 | 8/2002 |
| WO | WO 02/074490 A1 | 9/2002 |

OTHER PUBLICATIONS

Volara® Type EO, Voltek Technical Data Sheet.

* cited by examiner

*Primary Examiner*—Robert A. Rose

(57) ABSTRACT

The present invention is directed to an abrasive article comprising a fixed abrasive layer and a subpad. The fixed abrasive element is co-extensive with the subpad. The subpad comprises a resilient element. The resilient element has a Shore A hardness of no greater than 60 as measured using ASTM-2240.

42 Claims, 3 Drawing Sheets

PAD CONSTRUCTIONS FOR CHEMICAL MECHANICAL PLANARIZATION APPLICATIONS

This application claims priority to the U.S. Provisional Application 60/439,314 filed Jan. 10, 2003.

FIELD

The present invention is directed to abrasive articles and methods of using said articles.

BACKGROUND

Semiconductor wafers have a semiconductor base. The semiconductor base can be made from any appropriate material such as single crystal silicon, gallium arsenide, and other semiconductor materials known in the art. Over a surface of the semiconductor base is a dielectric layer. This dielectric layer typically contains silicon dioxide, however, other suitable dielectric layers are also contemplated in the art.

Over the front surface of the dielectric layer are numerous discrete metal interconnects (e.g., metal conductor blocks). Each metal interconnect can be made, for example, from aluminum, copper, aluminum copper alloy, tungsten, and the like. These metal interconnects are typically made by first depositing a continuous layer of the metal on the dielectric layer. The metal is then etched and the excess metal removed to form the desired pattern of metal interconnects. Afterwards, an insulating layer is applied over top of each metal interconnect, between the metal interconnects and over the surface of the dielectric layer. The insulating layer is typically a metal oxide such as silicon dioxide, BPSG (borophosphosilicate glass), PSG (phosphosilicate glass), or combinations thereof. The resulting insulating layer often has a front surface that may not be as "planar" and/or "uniform" as desired.

Before any additional layers of circuitry can be applied via a photolithography process, it is desired to treat the front surface of the insulating layer to achieve a desired degree of "planarity" and/or "uniformity;" the particular degree will depend on many factors, including the individual wafer and the application for which it is intended, as well as the nature of any subsequent processing steps to which the wafer may be subjected. For the sake of simplicity, throughout the remainder of this application this process will be referred to as "planarization". As a result of planarization, the front surface of the insulating layer should be sufficiently planar such that when the subsequent photolithography process is used to create a new circuit design, the critical dimension features can be resolved. These critical dimension features form the circuitry design.

Other layers may also be planarized in the course of the wafer fabrication process. In fact, after each additional layer of insulating material is applied over the metal interconnects, planarization may be needed. The blank wafer may need to be planarized as well. Additionally, the wafer may include conductive layers, such as copper, that need planarization as well. A specific example of such a process is the metal Damascene processes. The planarization may be performed simultaneously with any layers being deposited.

In the Damascene process, a pattern is etched into an oxide dielectric (e.g., silicon dioxide) layer. Other suitable dielectric layers may include low dielectric constant (K) layers such as carbon doped oxides, porous carbon doped oxide, porous spin on dielectrics and polymeric films, and other materials having a dielectric constant generally in the range of 1.0 to 3.5, for example between 1.5 and 3.5. An insulating cap may then optionally be deposited on the dielectric layer. Examples of cap layers include silicon carbide and silicon nitride. Optional adhesion/barrier layers are deposited over the entire surface. Typical barrier layers may comprise tantalum, tantalum nitride, titanium or titanium nitride, for example. Next, a metal (e.g., copper) is deposited over the dielectric and any adhesion/barrier layers. The deposited metal layer is then modified, refined or finished by removing the deposited metal and optionally portions of the adhesion/barrier layer from the surface of the dielectric. Typically, enough surface metal is removed so that the outer exposed modified surface of the wafer comprises both metal, and either a barrier layer, a cap layer or an oxide dielectric material or a combination thereof. A top view of the exposed wafer surface would reveal a planar surface with metal corresponding to the etched pattern and dielectric material adjacent to the metal. The materials located on the modified surface of the wafer inherently have different physical characteristics, such as different hardness values. The abrasive treatment used to modify a wafer produced by the Damascene process is generally designed to simultaneously modify the metal and/or adhesion/barrier layers and/or cap layer and/or dielectric materials.

One conventional method of modifying or refining exposed surfaces of structured wafers treats a wafer surface with a slurry containing a plurality of loose abrasive particles dispersed in a liquid. Typically this slurry is applied to a polishing pad and the wafer surface is then ground or moved against the pad in order to remove material from the wafer surface. The slurry may also contain chemical agents or working liquids that react with the wafer surface to modify the removal rate. The above described process is commonly referred to as a chemical-mechanical planarization (CMP) process.

An alternative to CMP slurry methods uses an abrasive article to modify or refine a semiconductor surface and thereby eliminate the need for the foregoing slurries. The abrasive article generally includes a subpad construction. Examples of such abrasive articles can be found in U.S. Pat. Nos. 5,958,794; 6,194,317; 6,234,875; 5,692,950; and 6,007,407, which are incorporated by reference. The abrasive article generally has a textured abrasive surface which includes abrasive particles dispersed in a binder. In use, the abrasive article is contacted with a semiconductor wafer surface, often in the presence of a working liquid, with a motion adapted to modify a single layer of material on the wafer and provide a planar, uniform wafer surface. The working liquid is applied to the surface of the wafer to chemically modify or otherwise facilitate the removal of a material from the surface of the wafer under the action of the abrasive article.

SUMMARY

Use of a fixed abrasive article with a subpad in wafer planarization can lead to some undesirable effects. For example, some wafers may experience delamination at layer interfaces. The present application is directed to a new subpad and a method of using a sub pad. This new pad and the method of using a subpad result in better planarization without the undesirable effect.

The present invention is directed to an abrasive article comprising a fixed abrasive layer and a subpad. The fixed abrasive element is co-extensive with the subpad. The subpad comprises a resilient element. The resilient element has a Shore A hardness of no greater than 60 as measured using ASTM-2240.

Throughout this application, the following definitions apply:

"Surface modification" refers to wafer surface treatment processes, such as polishing and planarizing;

"Fixed abrasive element" refers to an abrasive article, that is substantially free of unattached abrasive particles except as may be generated during modification of the surface of the workpiece (e.g., planarization). Such a fixed abrasive element may or may not include discrete abrasive particles;

"Three-dimensional" when used to describe a fixed abrasive element refers to a fixed abrasive element, particularly a fixed abrasive article, having numerous abrasive particles extending throughout at least a portion of its thickness such that removing some of the particles at the surface during planarization exposes additional abrasive particles capable of performing the planarization function;

"Textured" when used to describe a fixed abrasive element refers to a fixed abrasive element, particularly a fixed abrasive article, having raised portions and recessed portions;

"Abrasive composite" refers to one of a plurality of shaped bodies which collectively provide a textured, three-dimensional abrasive element comprising abrasive particles and binder; and "Precisely shaped abrasive composite" refers to an abrasive composite having a molded shape that is the inverse of the mold cavity which is retained after the composite has been removed from the mold; preferably, the composite is substantially free of abrasive particles protruding beyond the exposed surfaces of the shape before the abrasive article has been used, as described in U.S. Pat. No. 5,152,917 (Pieper et al.).

DETAILED DESCRIPTION

The present invention provides an abrasive article for modifying an exposed surface of a workpiece such as a semiconductor wafer. The abrasive article includes a textured, fixed abrasive element and a subpad comprising a resilient element. These elements are substantially coextensive with each other. The fixed abrasive element is preferably a fixed abrasive article. Suitable three-dimensional, textured, fixed abrasive articles, typically comprising a backing on which is disposed an abrasive layer that includes a plurality of abrasive particles and a binder in the form of a pre-determined pattern, and methods for using them in semiconductor wafer processing are disclosed in such as those disclosed in U.S. Pat. No. 5,958,794, which is incorporated herein by reference.

The abrasive articles of the present invention include at least one resilient element in the subpad. For the purpose of the present invention, the resilient element has a Shore A hardness (as measured using ASTM-D2240) of not greater than about 60. In other embodiments, the Shore A hardness is not greater than about 30, for example not greater than about 20. In some embodiments, the Shore A hardness of the resilient element is not greater than about 10, and in certain embodiments, the resilient element has a Shore A hardness of not greater than about 4. In some embodiments, the Shore A hardness of the resilient element is greater than about 1, and in certain embodiments, the resilient element has a Shore A hardness of greater than about 2.

Figure 1:
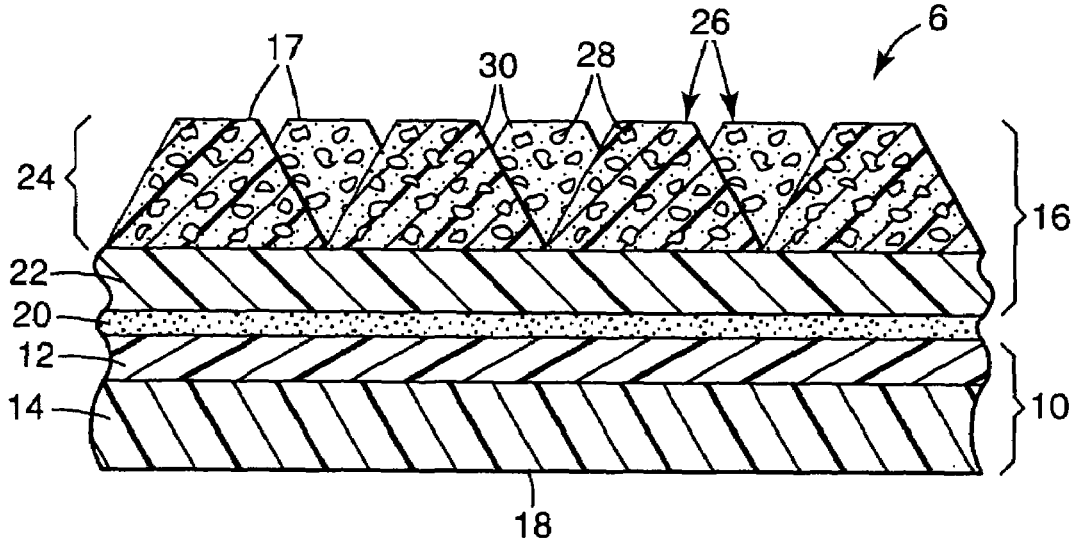
FIG. 1 is a cross-sectional view of a portion of an embodiment of a subpad of the present invention attached to a three-dimensional, textured, fixed abrasive element.

FIG. 1 is a cross sectional view of an example of one embodiment of a fixed abrasive article 6 used in the present process, including a subpad 10 and a fixed abrasive element 16. As shown in the embodiment of FIG. 1, subpad 10 includes at least one rigid element 12 and at least one resilient element 14, which is attached to the fixed abrasive element 16. However, in certain embodiments, the subpad has only a resilient element 14. Additionally, in certain embodiments, the subpad has more than one resilient element, more than one rigid element, or any combination of resilient and rigid elements. In the embodiment shown in FIG. 1, the rigid element 12 is interposed between the resilient element 14 and the fixed abrasive element 16. The fixed abrasive element 16 has surfaces 17 that contact a workpiece. Thus, in the abrasive constructions used in the present invention, the rigid element 12 and the resilient element 14 are generally co-continuous with, and parallel to, the fixed abrasive element 16, such that the three elements are substantially coextensive. Although not shown in FIG. 1, surface 18 of the resilient element 14 is typically attached to a platen of a machine for semiconductor wafer modification, and surfaces 17 of the fixed abrasive element 16 contacts the semiconductor wafer.

As shown in FIG. 1, this embodiment of the fixed abrasive element 16 includes a backing 22 having a surface to which is bonded a fixed abrasive layer 24, which includes a pre-determined pattern of a plurality of precisely shaped abrasive composites 26 comprising abrasive particles 28 dispersed in a binder 30. However, as stated above, the fixed abrasive element, and therefore the abrasive layer, may be free of discrete abrasive particles. In other embodiments, the fixed abrasive element is random, for example in textured fixed abrasive elements such as those sold under the tradename IC-1000 and IC-1010, (available from Rodel, Inc., Newark, Del.), and other conditioned fixed abrasive elements. Abrasive layer 24 may be continuous or discontinous on the backing. In certain embodiments, however, the fixed abrasive article does not require a backing. In some embodiments, the fixed abrasive layer has a Young's modulus of less than about 300 MPa, for example less than 75 MPa, and in further examples less than about 35 MPa.

Although FIG. 1 displays a textured, three-dimensional, fixed abrasive element having precisely shaped abrasive composites, the abrasive compositions of the present invention are not limited to precisely shaped composites. That is, other textured, three-dimensional, fixed abrasive elements are possible, such as those disclosed in U.S. Pat. No. 5,958,794, and in U.S. Application Publication No. 2002/0151253, which are incorporated herein by reference.

There may be intervening layers of adhesive or other attachment means between the various components of the abrasive construction. For example, as shown in the embodiment of FIG. 1, an adhesive layer 20 is interposed between the rigid element 12 and the backing 22 of the fixed abrasive element 16. Although not shown in FIG. 1, there may also be an adhesive layer interposed between the rigid element 12 and the resilient element 14, and on the surface 18 of the resilient element 14.

During use, the surfaces 17 of the fixed abrasive article 16 contact the workpiece, e.g., a semiconductor wafer, to modify the surface of the workpiece to achieve a surface that is more planar and/or more uniform and/or less rough than the surface prior to treatment. The underlying combination of the rigid and resilient elements of the subpad provides an abrasive construction that substantially conforms to the global topography of the surface of the workpiece (e.g., the overall surface of a semiconductor wafer) while not substantially conforming to the local topography of the surface of the workpiece (e.g., the spacing between adjacent features on the surface of a semiconductor wafer) during surface modification. As a result, the abrasive construction of the present invention will modify the surface of the workpiece in order to achieve the desired level of planarity, uniformity, and/or roughness. The particular degree of planarity, uniformity, and/or roughness desired will vary depending upon the individual wafer and the application for which it is intended, as well as the nature of any subsequent processing steps to which the wafer may be subjected.

Figure 2:
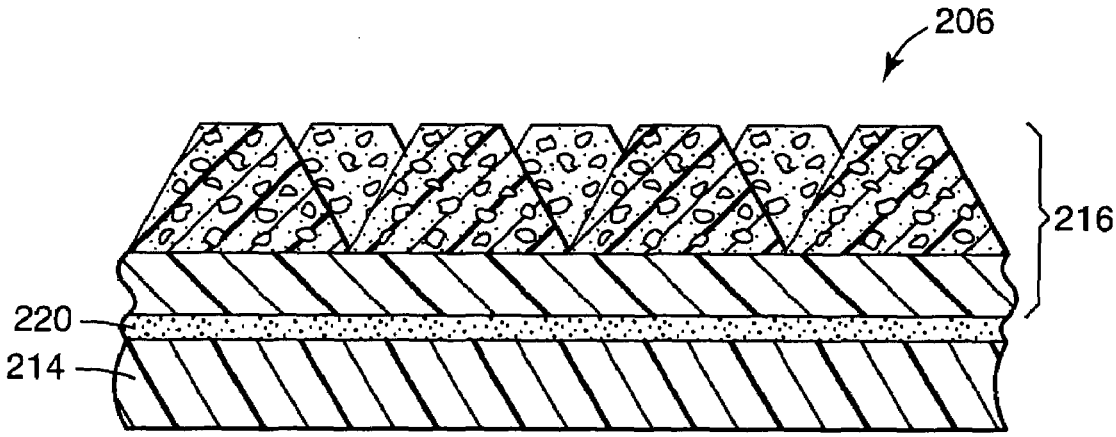
FIG. 2 is a cross-sectional view of a portion of a second embodiment of a subpad of the present invention attached to a three-dimensional, textured, fixed abrasive element.
Figure 3:
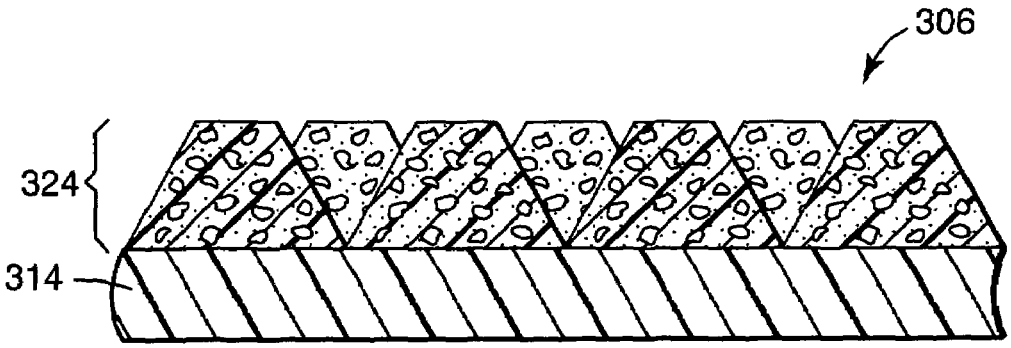
FIG. 3 is a cross-sectional view of a portion of a third embodiment of a subpad of the present invention attached to a three-dimensional, textured, fixed abrasive element.

FIG. 2 shows another embodiment of an abrasive article 206 of the present invention. A fixed abrasive element 216 and a resilient element 214 are joined by a pressure sensitive adhesive layer 220. FIG. 3 shows another embodiment of a fixed abrasive article 306 the present invention, wherein a fixed abrasive layer 324 is directly in contact with a resilient element 314.

Figure 4A:
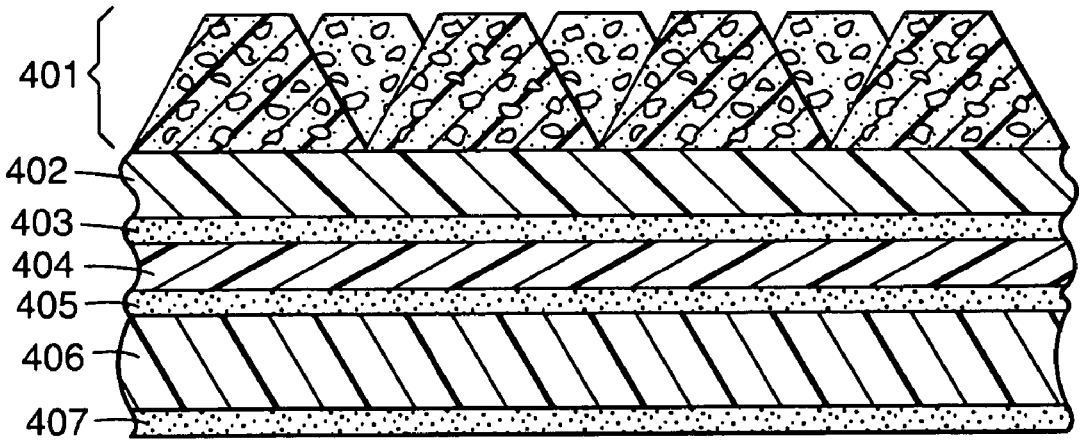
FIGS. 4A–4F are cross sectional views of numerous embodiments of the present invention.
Figure 4B:
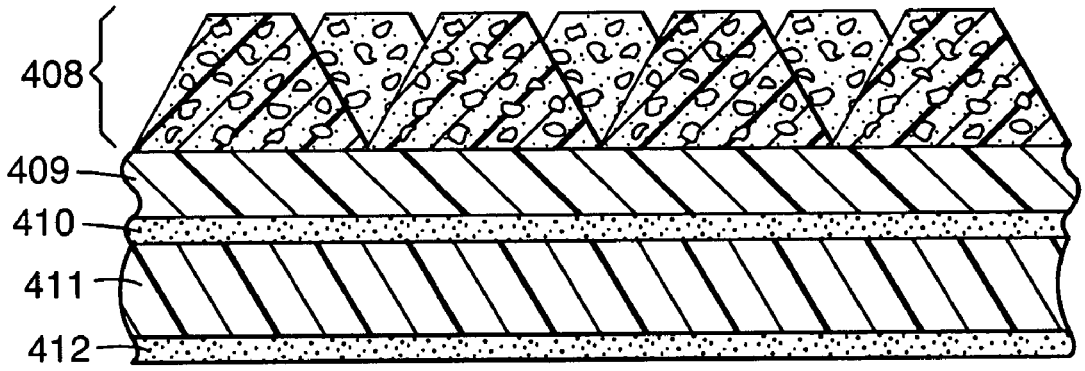
Figure 4C:
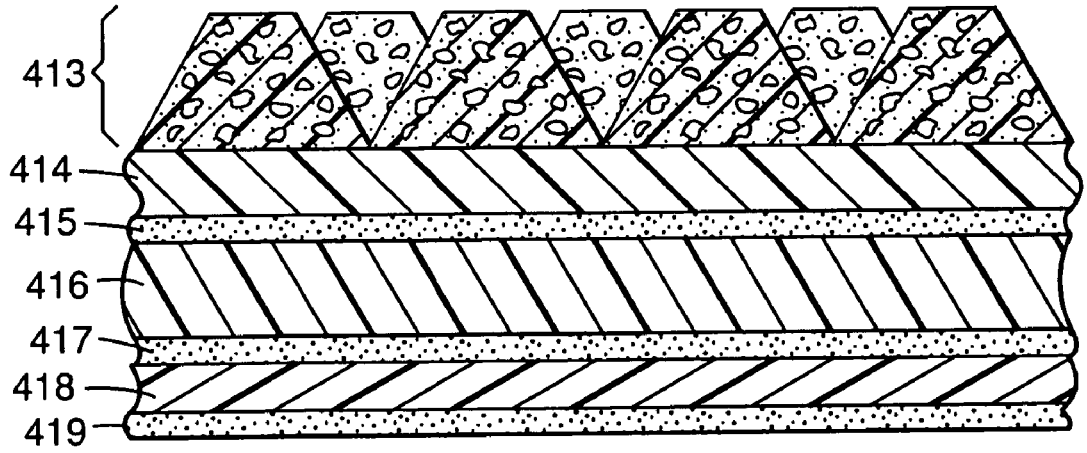
Figure 4D:
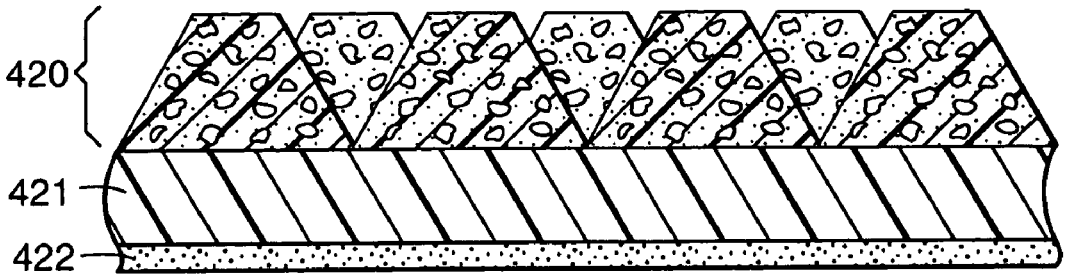
Figure 4E:
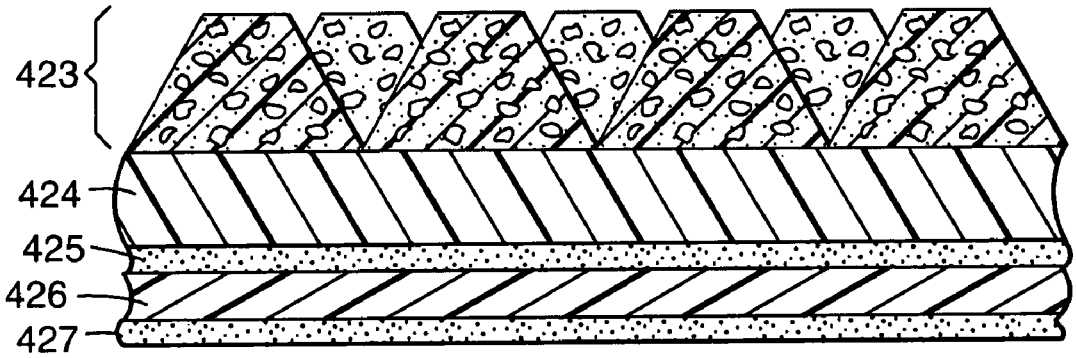
Figure 4F:
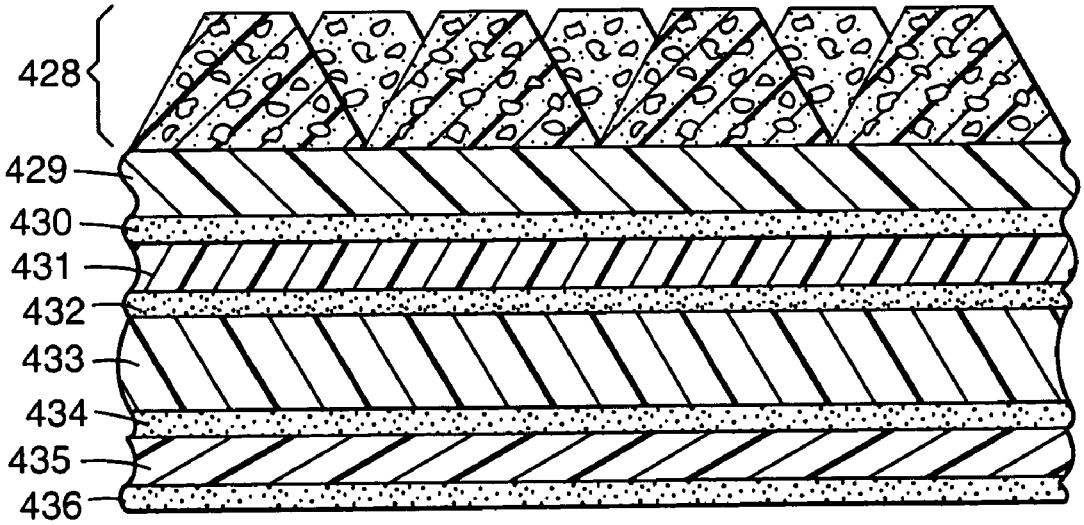

FIGS. 4A through 4F show examples of specific embodiments of the abrasive article of the present invention. FIG. 4(*a*) includes a fixed abrasive 401, a backing 402, a first pressure sensitive adhesive layer 403, a rigid element 404, a second pressure sensitive adhesive layer 405, a resilient element 406 and a third pressure sensitive adhesive layer 407. FIG. 4B includes a fixed abrasive 408, a backing 409, a first pressure sensitive adhesive layer 410, a resilient element 411 and a second pressure sensitive adhesive layer 412). FIG. 4C includes a fixed abrasive layer 413, a backing 414, a first pressure sensitive adhesive layer 415, a resilient element 416, a second pressure sensitive adhesive layer 417, a rigid element 418 and a third pressure sensitive adhesive layer 419. FIG. 4D includes a fixed abrasive layer 420, a resilient element 421 and a first pressure sensitive adhesive layer 422. FIG. 4E includes a fixed abrasive layer 423, a resilient element 424, a first pressure sensitive adhesive layer 425, a rigid element 426 and a second pressure sensitive adhesive layer 427. FIG. 4F includes a fixed abrasive layer 428, a backing 429, a first pressure sensitive adhesive layer 430, a first rigid element 431, a second pressure sensitive adhesive layer 432, a resilient element 433, a third pressure sensitive adhesive layer 434, a second rigid element 435 and a fourth pressure sensitive adhesive layer 436.

Although the abrasive constructions of the present invention are particularly suitable for use with processed semiconductor wafers (i.e., patterned semiconductor wafers with circuitry thereon, or blanket, nonpatterned wafers), they can be used with unprocessed or blank (e.g., silicon) wafers as well. Thus, the abrasive constructions of the present invention can be used to polish or planarize a semiconductor wafer.

The choice of materials for the resilient element will vary depending on the compositions of the workpiece surface and fixed abrasive element, the shape and initial flatness of the workpiece surface, the type of apparatus used for modifying the surface (e.g., planarizing the surface), the pressures used in the modification process, etc. The abrasive construction of the present invention can be used for a wide variety of semiconductor wafer modification applications.

The materials suitable for use in the subpad can be characterized using standard test methods proposed by ASTM, for example. Any given material will have inherent properties, for example density, tensile strength, Shore hardness and elastic modulus. Static tension testing of rigid materials can be used to measure the Young's Modulus (often referred to as the elastic modulus) in the plane of the material. For measuring the Young's Modulus of a metal, ASTM E345-93 (Standard Test Methods of Tension Testing of Metallic Foil) can be used. For measuring the Young's Modulus of an organic polymer (e.g., plastics or reinforced plastics), ASTM D638-84 (Standard Test Methods for Tensile Properties of Plastics) and ASTM D882-88 (Standard Tensile Properties of Thin Plastic Sheet) can be used. For laminated elements that include multiple layers of materials, the Young's Modulus of the overall element (i.e., the laminate modulus) can be measured using the test for the highest modulus material.

Dynamic compressive testing of resilient materials can be used to measure the Young's Modulus (often referred to as the storage or elastic modulus) in the thickness direction of the material. Herein, for resilient materials ASTM D5024-94 (Standard Test Methods for Measuring the Dynamic Mechanical Properties of Plastics in Compression) may be used, whether the resilient element is one layer or a laminated element that includes multiple layers of materials. Preferably, resilient materials (or the overall resilient element itself) have a Young's Modulus value of less than about 100 MPa, for example less than about 50 MPa. Herein, the Young's Modulus of the resilient element is determined by ASTM D5024-94 in the thickness direction of the material at 20 degree C. and 0.1 Hz with a preload of 34.5 kPa.

Suitable resilient materials can also be chosen by additionally evaluating their stress relaxation. Stress relaxation is evaluated by deforming a material and holding it in the deformed state while the force or stress needed to maintain deformation is measured. Suitable resilient materials (or the overall resilient element) preferably retain at least about 60% (more preferably at least about 70%) of the initially applied stress after 120 seconds. This is referred to herein, including the claims, as the "remaining stress" and is determined by first compressing a sample of material no less than 0.5 mm thick at a rate of 25.4 mm/minute until an initial stress of 83 kPa is achieved at room temperature (20'–25 degree C.), and measuring the remaining stress after 2 minutes.

Resilient materials for use in the abrasive constructions can be selected from a wide variety of materials. Typically, the resilient material is an organic polymer, which can be thermoplastic or thermoset and may or may not be inherently elastomeric. The materials generally found to be useful resilient materials are organic polymers that are foamed or blown to produce porous organic structures, which are typically referred to as foams. Such foams may be prepared from natural or synthetic rubber or other thermoplastic elastomers such as polyolefins, polyesters, polyamides, polyurethanes, and copolymers thereof, for example. Suitable synthetic thermoplastic elastomers include, but are not limited to, chloroprene rubbers, ethylene/propylene rubbers, butyl rubbers, polybutadienes, polyisoprenes, EPDM polymers, polyvinyl chlorides, polychloroprenes, or styrene/butadiene copolymers. A particular example of a useful resilient material is a copolymer of polyethylene and ethylene vinyl acetate in the form of a foam.

Resilient materials may also be of other constructions if the appropriate mechanical properties (e.g., Young's Modulus and remaining stress in compression) are attained. Polyurethane impregnated felt-based materials such as are used in conventional polishing pads can be used, for example. The resilient material may also be a nonwoven or woven fiber mat of, for example, polyolefin, polyester, or polyamide fibers, which has been impregnated by a resin (e.g. polyurethane). The fibers may be of finite length (i.e., staple) or substantially continuous in the fiber mat.

Specific resilient materials that are useful in the abrasive constructions of the present invention include, but are not limited to those sold under the tradenames VOLTEC VOLARA type EO closed cell foams, commercially available from Voltek, a division of Sekisui America Corp., Lawrence, Mass.

The abrasive constructions of the present invention can further include means of attachment between the various components. For example, the construction shown in FIG. 1 is prepared by laminating a sheet of rigid material to a sheet of resilient material. Lamination of these two elements can be achieved by any of a variety of commonly known bonding methods, such as hot melt adhesive, pressure sensitive adhesive, glue, tie layers, bonding agents, mechanical fastening devices, ultrasonic welding, thermal bonding, microwave-activated bonding, or the like. Alternatively, the rigid portion and the resilient portion of the subpad could be brought together by coextrusion.

Typically, lamination of elements is readily achieved by use of an adhesive, of the pressure sensitive or hot melt type. Suitable pressure sensitive adhesives can be a wide variety of the commonly used pressure sensitive adhesives, including, but not limited to, those based on natural rubber, (meth)acrylate polymers and copolymers, AB or ABA block copolymers of thermoplastic rubbers such as styrene/butadiene or styrene/isoprene block copolymers available under the trade designation KRATON (Shell Chemical Co., Houston, Tex.), or polyolefins. Suitable hot melt adhesives include, but are not limited to, a wide variety of the commonly used hot melt adhesives, such as those based on polyester, ethylene vinyl acetate (EVA), polyamides, epoxies, and the like. The principle requirements of the adhesive are that it has sufficient cohesive strength and peel resistance for the subpad elements to remain in place during use, that it is resistant to shear under the conditions of use, and that it is resistant to chemical degradation under conditions of use.

The fixed abrasive element can be attached to the subpad portion of the construction by the same means outlined immediately above—adhesives, coextrusion, thermal bonding, mechanical fastening devices, etc. However, it need not be attached to the subpad, but may be maintained in a position immediately adjacent to it and coextensive with it. In this case some mechanical means of holding the fixed abrasive in place during use will be required, such as placement pins, retaining ring, tension, vacuum, etc.

The abrasive article described herein is placed onto a machine platen for use in modifying the surface of a silicon wafer, for example. It may be attached by an adhesive or mechanical means, such as placement pins, retaining ring, tension, vacuum, etc.

The abrasive constructions of the present invention can be used on many types of machines for planarizing semiconductor wafers, as are well known in the art for use with polishing pads and loose abrasive slurries. Examples of suitable machines include those sold under the tradenames MIRRA and REFLEXION WEB POLISHER (from Applied Materials, Santa Clara, Calif.).

Typically, such machines include a head unit with a wafer holder, which may consist of both a retaining ring and a wafer support pad for holding the semiconductor wafer. Typically, both the semiconductor wafer and the abrasive article move relative to one another. The wafer holder rotates either in a circular fashion, spiral fashion, elliptical fashion, a nonuniform manner, or a random motion fashion. The abrasive article can rotate, move linearly relative to the wafer surface or remain stationary. The speed at which the wafer holder rotates will depend on the particular apparatus, planarization conditions, abrasive article, and the desired planarization criteria. In general, however, the wafer holder rotates at a rate of about 2–1000 revolutions per minute (rpm).

The abrasive construction of the present invention will typically be circular and have a diameter of about 10–200 cm, preferably about 20–150 cm, more preferably about 25–100 cm. It may rotate as well, typically at a rate of about 5–10,000 rpm, preferably at a rate of about 10–1000 rpm, and more preferably about 10–250 rpm. The abrasive article may also be in the form of a continuous belt or web. In these instances, the abrasive article may move with a characteristic lineal speed, for example 0.038–75 m/sec. Surface modification procedures which utilize the abrasive constructions of the present inventions typically involve pressures of about 6.9–138 kPa.

Generally, the process will be performed in the presence of a working liquid. Such a working liquid may contain abrasive particles or may be free of abrasive particles. Suitable working liquids are described in U.S. Pat. No. 6,194,317 and in U.S. Application Publication No. US 2002/0151253, which are incorporated herein by reference.

Various modifications and alterations of this invention will become apparent to those skilled in the art without departing from the scope and spirit of this invention, and it should be understood that this invention is not to be unduly limited to the illustrative embodiments set forth herein.

EXAMPLES

Test Procedures

Young's Modulus

The Young's Modulus of the fixed abrasive composite materials used in the present invention were determined using a static tension test similar to that described in ASTM D638-84 (Standard Test Methods for Tensile Properties of Plastics) and ASTM D-882-88 (Standard Tensile Properties of Thin Plastic Sheeting). Modifications to the test procedure relevant to the current testing included the use of small dumbbells; cut from molded plaques of the fixed abrasive;

having a gauge length of 12.7 mm, a width of 3.2 mm and a thickness in the range of 0.43–0.71 mm. Also, the extension rate during testing is 0.0212 mm/s.

Wafer Delamination

Wafer delamination was observed visually. A rating system was developed such that the degree of delamination was measured on a relative scale from 1–5. A rating of 1 indicates delamination of less than 1% of the wafer surface. A rating of 5 represents delamination over approximately 10% of the wafer surface.

Materials

Fixed Abrasive

One of the fixed abrasives, in coated film form, employed in this study was Cu CMP disc M6100 (MWR66) 20 inch O.D. (product number 60-0700-0523-0) available from the 3M Company (St. Paul, Minn.). As received, the fixed abrasive was coated onto a 3 mil Poly(ethylene terephthalate) (PET) backing which in turn was laminated onto a specified subpad. A second product similar in composition designated MWR73 was also tested in the 20 inch diameter coated, film construction. It is nearly identical to the M6100 fixed abrasive except that the Young's modulus was measured to be lower.

MWR66 abrasive composite Young's modulus=72.4 MPa

MWR73 abrasive composite Young's modulus=33.1 MPa

Subpads

Rigid Component

The rigid component used in the present invention was polycarbonate, 8010MC Lexan Polycarbonate (PC) sheeting from GE Polymershapes (Mount Vernon, Ind.). The sheeting thickness employed was 0.508 mm (20 mil). Although one thickness was employed, the thickness of the PC sheeting may vary in the range from 0.0508 mm to 2.5 mm. Other polymers and materials could also be used for this element.

Resilient Component

All of the resilient components used in the following examples were closed cell foams available from Voltek, a division of Sekisui America Corp. (Lawrence, Mass.).

VOLTEC VOLARA Type EO foam 2 pcf (pounds per cubic foot foam density), 3.175 mm thick (125 mil).

VOLTEC VOLARA Type EO foam 4 pcf, 2.38 mm–3.175 mm thick (90–125 mil).

VOLTEC VOLARA Type EO foam 6 pcf, 2.38 mm–3.175 mm thick (90–125 mil).

VOLTEC VOLARA Type EO foam 12 pcf, 2.38 mm–3.175 mm thick (90–125 mil).

Representative properties of these foams were provided by the supplier and are shown in Table 1 below.

TABLE 1

Properties of VOLTEC VOLARA Type EO Closed Cell Foams

| Property | 2 pcf | 4 pcf | 6 pcf | 12 pcf |
|---|---|---|---|---|
| Density (kg/m$^3$) | 0.00320 | 0.00641 | 0.00961 | 0.0176 |
| Density Range (kg/m$^3$) | +/−0.00032 | +/−0.000641 | +/−0.000961 | +/−0.00176 |
| Compression Strength | | | | |
| MPa @ 25% | 0.0276 | 0.0483 | 0.0552 | 0.919* |
| MPa @ 50% | 0.0828 | 0.1103 | 0.1379 | 0.2066* |
| (ASTM D3575) | | | | |
| Tensile Strength M (MPa) | 0.476 | 0.959 | 1.531 | 2.962* |
| Tensile Strength CM (MPa) | 0.310 | 0.697 | 1.097 | 2.076* |
| (ASTM D3575) | | | | |
| Elongation to Break M (%) | 253 | 329 | 361 | 503* |
| Elongation to Break CM (%) | 232 | 324 | 364 | 536* |
| (ASTM D3575) | | | | |
| Tear Resistance M (MPa) | 0.0621 | 0.124 | 0.179 | 0.3259* |
| Tear Resistance CM (MPa) | 0.0759 | 0.1448 | 0.2069 | 0.3713* |
| (ASTM D3575) | | | | |
| Compression Set (% of Original Thickness) | 29 | 18 | 7 | — |
| (ASTM D3575) | | | | |
| Shore Hardness A Scale | 4 | 10 | 30 | 60* |
| Shore Hardness OO Scale | 45 | 55 | 65 | 90* |
| (ASTM D2240) | | | | |

*Indicates data estimated from linear extrapolation of property (y-axis) vs. foam density (x-axis)

Unless otherwise noted, the thickness of the foam used was 2.38 mm. Although 2.38 mm thick foams were employed, it is expected that the foam thickness in the pad constructions can vary in range from 0.127 mm to 5 mm. Other foams could be used for this element. Additionally, the resilient element could be composed of two or more resilient elements that are predominantly coextensive to one another.

Pressure Sensitive Adhesives (PSAs)

3M 442 DL (dual sided PSA), 3M 9471 FL and 3M 9671 PSA (all available from the 3M Company, St. Paul, Minn.) were used for the PSAs as described in FIGS. 4A–4F. The specific PSAs used for pad construction are detailed in the description of the specific Examples. Other PSAs and adhesives could be employed for the PSA layers of the various pad constructions.

Subpad and Pad Lamination

All subpads and pads were laminated together taking great care to prevent the trapping of air or debris between layers. Additionally, one needs to take great care to prevent the wrinkling/creasing of the abrasive element, the rigid element and the resilient element during the laminating process.

CMP

Polishing Solutions

Cu CMP Solution CPS-11(product #60-4100-0563-5) and Cu CMP Solution CPS-12(product #60-4100-0575-9) were used for the studies. They were obtained from the 3M Company (St. Paul, Minn.). The appropriate amount of 30% (by weight) hydrogen peroxide was added to the solutions prior to polishing. The CPS-11/30% $H_2O_2$ weight ratio is 945/55. The CPS-12/30% $H_2O_2$ weight ratio is 918/82.

Wafers

Metal level 2(M2) wafers were obtained from International Sematech, (Austin, Tex.). The ultra low K substrate was JSR LKD-5109 (from JSR microelectronics, Sunnyvale, Calif.). The wafers were processed using JSR LKD-5109 and the ISMT 800AZ Dual Damascene Reticle set.

General Polishing Procedure

A polishing pad was laminated to the platen of the MIRRA polishing tool via the bottom layer of PSA. The pad was high pressure rinsed with DI water for 10 seconds. The pad was conditioned using a MIRRA 3400 Chemical-Mechanical Polishing System (Applied Materials, Inc., Santa Clara, Calif.) by polishing an 8 inch diameter copper (Cu) disc for 6 minutes at a platen speed of 101 rpm and a carrier speed of 99 rpm and delivering a polishing solution, CPS-11 w/hydrogen peroxide, near to the pad center at a flow rate of 120 ml/min. During this polish, the pressures applied to the TITAN carrier inner tube, retaining ring and membrane were 4.5 psi, 5.0 psi, 4.5 psi, respectively. After conditioning the pad, a two step Cu polishing sequence was employed for the polishing of the M2 pattern wafers. The first step used CPS-11 polishing solution with hydrogen peroxide at a flow rate of 180 ml/min delivered near to the center of the pad. The pressures applied to the carrier inner tube, retaining ring and membrane of the TITAN carrier are 1.0 psi/1.5 psi/1.0 psi, respectively. The platen and carrier speeds are 31 rpm and 29 rpm, respectively. Polishing was conducted for 45s at these conditions. After this polish, the substrate surface is predominately Cu, with none of the die region's underlying ILD/cap/barrier layers being exposed. The wafer was removed and examined visually for substrate delamination. After a 10s high pressure rinse of the pad, the second polish employed CPS-12 polishing solution with hydrogen peroxide at a flow rate of 180 ml/min delivered near to the center of the pad. The pressures applied to the carrier inner tube, retaining ring and membrane of the TITAN carrier were 1.0 psi/1.5 psi/1.0 psi, respectively. The platen and carrier speeds were 31 rpm and 29 rpm, respectively. The polishing time was variable, being the time required to clear the wafer, typically 170–190s followed by an additional 20s overpolish using the identical process conditions. After polishing, wafers were again examined for visual delamination.

Dechuck Conditions

In the wafer removal section of the MIRRA software, various dechuck conditions can be set. The dechuck condition variations between Examples 1A–1D and Examples 2A–2D are shown below. Example 3 used dechuck conditions identical to those of Examples 2A–2D.

Dechuck Conditions for Examples 1A–1D (Standard Dechuck Conditions)

6—TITAN carrier Dechuck: Inner tube pressure before membrane vacuum. 3.0 p.s.i.

7—TITAN carrier Dechuck: Retaining Ring pressure before membrane vacuum. 2.0 p.s.i.

8—TITAN carrier Dechuck: Membrane pressure before membrane vacuum. 1.0 p.s.i.

9—TITAN carrier Dechuck: Time to hold above pressure before membrane vacuum. 2500 msec 10—TITAN carrier Dechuck: Time to apply membrane vacuum. 3000 msec 11—TITAN carrier Dechuck: Inner Tube pressure after membrane vacuum. 1.0 p.s.i.

12—TITAN carrier Dechuck: Time to wait for 2nd inner tube pr to settle. 2500 msec 13—TITAN carrier Dechuck: Time to wait for head to pull wafer off pad. 3000 msec Dechuck Conditions for Examples 2A–2C and Example 3 (Mild Dechuck Conditions)

6—TITAN carrier Dechuck: Inner tube pressure before membrane vacuum. 0.8 p.s.i.

7—TITAN carrier Dechuck: Retaining Ring pressure before membrane vacuum. 0.5 p.s.i.

8—TITAN carrier Dechuck: Membrane pressure before membrane vacuum. −1.0 p.s.i.

9—TITAN carrier Dechuck: Time to hold above pressure before membrane vacuum. 250 msec 10—TITAN carrier Dechuck: Time to apply membrane vacuum. 750 msec 11—TITAN carrier Dechuck: Inner Tube pressure after membrane vacuum. 0.8 p.s.i.

12—TITAN carrier Dechuck: Time to wait for 2nd inner tube pr to settle. 250 msec 13—TITAN carrier Dechuck: Time to wait for head to pull wafer off pad. 750 msec Examples 1A–1D Following the general polishing procedure described above, two pad constructions, were examined using two different fixed abrasive types. Pad Construction 1 was as shown in FIG. 4(*a*), including a fixed abrasive 401, a backing 402, a first pressure sensitive adhesive layer 403, a rigid element 404, a second pressure sensitive adhesive layer 405, a resilient element 406 and a third pressure sensitive adhesive layer 407. The pressure sensitive adhesive layer 407 was 3M 442 DL, the pressure sensitive adhesive layer 403 was 3M 9471 FL, and the pressure sensitive adhesive layer 405 was 3M 9671 (all available from 3M Company, St. Paul, Minn.). Pad Construction 3 was as shown in FIG. 4C, including a fixed abrasive layer 413, a backing 414, a first pressure sensitive adhesive layer 415, a resilient element 416, a second pressure sensitive adhesive layer 417, a rigid element 418 and a third pressure sensitive adhesive layer 419. The third pressure sensitive adhesive layer 419 was 3M 9471 FL, the first pressure sensitive adhesive layer 415 was 3M 442 DL and the second pressure sensitive adhesive layer 417 was 3M 9671 (available from 3M Company, St. Paul, Minn.). Pad constructions, fixed abrasive types along with the results after the 2nd Cu step polishing process are shown in Table 2 (below). No delamination was observed on any of the wafers after the first step, CPS-11, Cu polish.

TABLE 2

Pad Construction, Fixed Abrasive Type, Wafer Identification and Polishing Results for Example 1

| Example | Fixed Abrasive | Pad Construction | Wafer Delamination Rating |
|---|---|---|---|
| 1A | MWR66 | 1 | 5 |
| 1B | MWR73 | 1 | 4 |

TABLE 2-continued

Pad Construction, Fixed Abrasive Type, Wafer Identification and Polishing Results for Example 1

| Example | Fixed Abrasive | Pad Construction | Wafer Delamination Rating |
|---|---|---|---|
| 1C | MWR66 | 3 | 4 |
| 1D | MWR73 | 3 | 3 |

Pad Construction 3 showed improved wafer delamination behavior compared to Pad Construction 1. Similarly, the MWR73 abrasive composite showed improved wafer delamination behavior compared to the MWR66 abrasive composite.

Examples 2A–2C

Following the general polishing procedure described above, Pad Construction 2 (see FIG. 4B, including a fixed abrasive 408, a backing 409, a first pressure sensitive adhesive layer 410, a resilient element 411 and a second pressure sensitive adhesive layer 412) was examined using pads prepared from the 12 pcf, 6 pcf and 4 pcf Voltek foams of Table 1 and the MWR73 fixed abrasive. For the pads of Examples 2A–2C, 3M 442 DL was used for both pressure sensitive adhesive layers 410 and 412. One modification to the general polishing procedure included decreasing the I-tube pressure to 0.6 psi. Also, the polishing times for the two polishing steps differed slightly from those described in Example 1A–1 D. For these examples, the polishing times for the CPS-11 and CPS-12polishing are documented in Table 3. The wafer of Example 2B was over-polished 20s using standard polishing conditions and CPS-12 polishing solution. No delamination was observed on any of the wafers after the first step, CPS-11, Cu polish.

Delamination results are shown in Table 3. Clearly, the articles containing a resilient element of lower density/hardness/tensile strength, showed improvement in the delamination behavior. Over-polishing, at these process conditions (Example 2B), did not significantly increase the degree of delamination. Also comparing Example 1D to Example 2A, delamination was improved by modifying the wafer dechuck conditions to be more mild.

TABLE 3

Pad Construction 2: Polishing Parameters, Wafer Identification and Polishing Results for Example 2

| Example | Foam | Time(s) | Polishing Solution | Wafer Delamination Rating |
|---|---|---|---|---|
| 2A | 12 pcf | 50 | CPS-11 | |
| 2A | 12 pcf | 150 | CPS-12 | 2 |
| 2B | 6 pcf | 45 | CPS-11 | |
| 2B | 6 pcf | 176 | CPS-12 | 1.5 |
| 2B | 6 pcf | 20 | CPS-12 | 1.5 |
| 2C | 4 pcf | 50 | CPS-11 | |
| 2C | 4 pcf | 150 | CPS-12 | 1 |

Example 3

Comparison of Dechuck Conditions

Pad Construction 1 was examined using the MWR66 fixed abrasive and the 12 pcf Voltek foam. Polishing was conducted with the milder dechuck conditions. Polishing process conditions were identical to that of Examples 1A–1D, except the polishing time for the CPS-11 polish was 65 seconds and the CPS-12 polish time is 100s plus an additional 5 seconds of over-polish.

The Wafer Delamination Rating for this wafer was 3.5. Compared to the wafer of example 1A, decreasing the severity of the dechuck conditions improved the wafer delamination.

What is claimed is:

1. An abrasive article comprising a fixed abrasive element comprising a fixed abrasive layer, said fixed abrasive layer comprising a plurality of precisely shaped abrasive composites; and a subpad comprising a resilient element, wherein the fixed abrasive element is co-extensive with the subpad and the resilient element has a Shore A hardness of no greater than 60 as measured using ASTM-2240, and wherein the Young's modulus of the fixed abrasive layer is less than about 300 MP.

2. The abrasive article of claim 1, wherein the subpad comprises a rigid element between the fixed abrasive layer and the resilient element.

3. The abrasive article of claim 1, further comprising a backing between the fixed abrasive layer and the resilient element.

4. The abrasive article of claim 1, further comprising a pressure sensitive adhesive layer between the abrasive layer and the subpad.

5. The abrasive article of claim 2 further comprising a pressure sensitive adhesive layer between the rigid element and the resilient element.

6. The abrasive article of claim 1 wherein the Young's modulus of the fixed abrasive layer is less than about 75 MPa.

7. The abrasive article of claim 1 wherein the Young's modulus of the fixed abrasive layer is less than about 35 MPa.

8. A method of polishing a semiconductor wafer comprising providing an abrasive article of claim 1;

contacting the abrasive article to a surface of the wafer; and relatively moving the abrasive article and the surface.

9. The method of claim 8 wherein the wafer comprises a material having a dielectric constant less than 3.5.

10. An abrasive article comprising a fixed abrasive element; and a subpad comprising a resilient element, wherein the fixed abrasive element is co-extensive with the subpad and the resilient element has a Shore A hardness of no greater than 20 as measured using ASTM-2240.

11. The abrasive article of claim 10 wherein the resilient element has a Shore A hardness of no greater than 10 as measured using ASTM-2240.

12. The abrasive article of claim 10 wherein the resilient element has a Shore A hardness of no greater than 4 as measured using ASTM-2240.

13. The abrasive article of claim 10, wherein the subpad comprises a rigid element between the fixed abrasive element and the resilient element.

14. The abrasive article of claim 10, wherein the fixed abrasive element comprises a fixed abrasive layer and a backing, wherein the backing is between the fixed abrasive layer and the resilient element.

15. The abrasive article of claim 10, further comprising a pressure sensitive adhesive layer between the abrasive element and the subpad.

16. The abrasive article of claim 13 further comprising a pressure sensitive adhesive layer between the rigid element and the resilient element.

17. The abrasive article of claim 10 wherein the fixed abrasive element comprises a fixed abrasive layer and the Young's modulus of the fixed abrasive layer is less than about 300 MPa.

18. The abrasive article of claim 10 wherein the fixed abrasive element comprises a fixed abrasive layer and the Young's modulus of the fixed abrasive layer is less than about 75 MPa.

19. The abrasive article of claim 10 wherein the fixed abrasive element comprises a fixed abrasive layer and the Young's modulus of the fixed abrasive layer is less than about 35 MPa.

20. A method of polishing a semiconductor wafer comprising providing an abrasive article of claim 10;

contacting the abrasive article to a surface of the wafer; and relatively moving the abrasive article and the surface.

21. The method of claim 20 wherein the wafer comprises a material having a dielectric constant less than 3.5.

22. An abrasive article comprising a fixed abrasive element comprising a fixed abrasive layer, said fixed abrasive layer comprising a plurality of precisely shaped abrasive composites; and a subpad comprising a resilient element, wherein the fixed abrasive element is co-extensive with the subpad and the resilient element has a Shore A hardness of greater than 1 as measured using ASTM-2240, and wherein the Young's modulus of the fixed abrasive layer is less than about 300 MPa.

23. The abrasive article of claim 22 wherein the resilient element has a Shore A hardness of greater than 2 as measured using ASTM-2240.

24. The abrasive article of claim 22, wherein the subpad comprises a rigid element between the fixed abrasive layer and the resilient element.

25. The abrasive article of claim 22, further comprising a backing between the fixed abrasive layer and the resilient element.

26. The abrasive article of claim 22, further comprising a pressure sensitive adhesive layer between the abrasive layer and the subpad.

27. The abrasive article of claim 24 further comprising a pressure sensitive adhesive layer between the rigid element and the resilient element.

28. The abrasive article of claim 22 wherein the Young's modulus of the fixed abrasive layer is less than about 75 MPa.

29. The abrasive article of claim 22 wherein the Young's modulus of the fixed abrasive layer is less than about 35 MPa.

30. A method of polishing a semiconductor wafer comprising providing an abrasive article of claim 22;

contacting the abrasive article to a surface of the wafer; and relatively moving the abrasive article and the surface.

31. The method of claim 30 wherein the wafer comprises a material having a dielectric constant less than 3.5.

32. An abrasive article comprising a fixed abrasive element comprising a fixed abrasive layer, and a subpad comprising a resilient element, wherein the fixed abrasive element is co-extensive with the subpad, the Young's modulus of the fixed abrasive layer is less than about 75 MPa, and the resilient element has a Shore A hardness of no greater than 60 as measured using ASTM-2240.

33. The abrasive article of claim 32, wherein the subpad comprises a rigid element between the fixed abrasive element and the resilient element.

34. The abrasive article of claim 32, further comprising a backing between the fixed abrasive layer and the resilient element.

35. The abrasive article of claim 32, further comprising a pressure sensitive adhesive layer between the abrasive element and the subpad.

36. The abrasive article of claim 32 wherein the Young's modulus of the fixed abrasive layer is less than about 35 MPa.

37. An abrasive article comprising a fixed abrasive element, and a subpad comprising a resilient element, wherein the fixed abrasive element is co-extensive with the subpad, the resilient element is at least 0.5 millimeter thick, the resilient element has a Shore A hardness of no greater than 60 as measured using ASTM-2240, and the fixed abrasive element comprises a fixed abrasive layer and the Young's modulus of the fixed abrasive layer is less than about 300 MPa.

38. The abrasive article of claim 37, wherein the subpad comprises a rigid element between the fixed abrasive element and the resilient element.

39. The abrasive article of claim 37, further comprising a backing between the fixed abrasive layer and the resilient element.

40. The abrasive article of claim 37, further comprising a pressure sensitive adhesive layer between the abrasive element and the subpad.

41. The abrasive article of claim 37 wherein the fixed abrasive element comprises a fixed abrasive layer and the Young's modulus of the fixed abrasive layer is less than about 75 MPa.

42. The abrasive article of claim 37 wherein the fixed abrasive element comprises a fixed abrasive layer and the Young's modulus of the fixed abrasive layer is less than about 35 MPa.

* * * * *